US006568145B2

(12) United States Patent
Bartel

(10) Patent No.: US 6,568,145 B2
(45) Date of Patent: May 27, 2003

(54) MODE OF INSTALLATION OF A PRE-MANUFACTURED STAIR BALUSTRADE

(75) Inventor: A. Gary Bartel, Sacramento, CA (US)

(73) Assignee: Blue Ribbon Stairs, Inc., Sacramento, CA (US)

( * ) Notice: Subject to any disclaimer, the term of this patent is extended or adjusted under 35 U.S.C. 154(b) by 44 days.

(21) Appl. No.: 09/844,770

(22) Filed: Apr. 30, 2001

(65) Prior Publication Data

US 2002/0157343 A1 Oct. 31, 2002

Related U.S. Application Data

(62) Division of application No. 09/313,607, filed on May 18, 1999, now Pat. No. 6,290,212.

(51) Int. Cl.[7] ..... E04H 17/00; E04F 11/18

(52) U.S. Cl. ..... 52/741.2; 52/720.2; 52/182; 256/59; 256/65

(58) Field of Search ..... 52/720.2, 741.2, 52/745.1, 182, 296; 256/59, 68, 69, 65.01

(56) References Cited

U.S. PATENT DOCUMENTS

| | | | | | |
|---|---|---|---|---|---|
| 2,625,815 | A | * | 1/1953 | Black | 52/126.1 |
| 3,256,659 | A | * | 6/1966 | Dudoff | 102/462 |
| 3,352,541 | A | * | 11/1967 | Thom | 256/21 |
| 4,104,000 | A | * | 8/1978 | Fleischmann | 256/65.14 |
| 4,367,864 | A | * | 1/1983 | Eldeen | 256/59 |
| 5,095,668 | A | * | 3/1992 | O'Brien et al. | 256/22 |
| 5,261,201 | A | * | 11/1993 | Smith | 256/69 |
| 5,370,368 | A | * | 12/1994 | Terrels et al. | 256/19 |
| 5,419,538 | A | * | 5/1995 | Nicholas et al. | 256/59 |
| 5,499,885 | A | * | 3/1996 | Chapman | 403/297 |
| 5,617,697 | A | * | 4/1997 | Erwin | 256/19 |
| 5,701,236 | A | * | 12/1997 | Viviano | 256/1 |
| 5,862,642 | A | * | 1/1999 | Erwin | 256/19 |
| 6,125,598 | A | * | 10/2000 | Lanphier | 256/65.14 |
| 6,141,928 | A | * | 11/2000 | Platt | 256/65.14 |

FOREIGN PATENT DOCUMENTS

| | | | | |
|---|---|---|---|---|
| DE | 4134139 A | * | 4/1993 | 256/59 |
| EP | 345213 | * | 12/1989 | 256/59 |
| EP | 489251 A1 | * | 10/1991 | E04F/11/02 |
| GB | 2145751 A | * | 4/1985 | 52/184 |
| JP | 406280366 A | * | 10/1994 | 256/59 |

* cited by examiner

*Primary Examiner*—Carl D. Friedman
*Assistant Examiner*—Brian E. Glessner
(74) *Attorney, Agent, or Firm*—Mark C. Jacobs

(57) ABSTRACT

A balustrade which features premade gallery, rake and starting newels and rail sections, and the process for installing the balustrade using the newel of this invention. The newel is a tubular member having an insert disposed at the lower end thereof, and optionally including a hex bolt which has intermediate machine screw threads, and distal lag screw threads, the machine screw threads thereof being in engagement with a coupler, disposed above a rigid plate, and the lag screw threads to be disposed within a support for the newel. The process includes the steps of mounting the new gallery, intermediate rake newel(s),—location dependent—mounting the starting newel, and attaching the rail section therebetween, and finishing off the upper portion of newels by attaching newel caps. The balustrade can utilize the newel of this invention at one or both of the gallery and starting newel locations, and at an intermediate rake location if employed.

7 Claims, 6 Drawing Sheets

MODE OF INSTALLATION OF A PRE-MANUFACTURED STAIR BALUSTRADE

This application is a divisional application of U.S. Ser. No. 07/313,607 filed May 18, 1999, now U.S. Pat. No. 6,290,212, issued in the name of A. Gary Bartel, on Sep. 18, 2001.

FIELD OF THE INVENTION

This invention relates to stairways and, in more particularity, to balustrades and their installation with emphasis on an improved premanufactured newel and the use thereof.

BACKGROUND OF THE INVENTION

During the recession of the early 1990's houses shrunk in size and amenities. After about mid-1995, with the recession being over, the housing market changed again, in that people wanted amenities, and builders wanted to satisfy this desire of the buying populous. The problems that existed then, and which, still are with us include the facts that while customers want amenities, such as wood balustrades, they often don't want to pay the extra cost associated with same. Due to the expense of an all wood balustrade they so oftentimes settle for a wrought iron one or a partial wall up the stairway with a handrail on the side of the wall. Another problem is that balustrade (handrail systems) installation has become a specialty trade and the tradesmen who install them make more money per hour than ordinary carpenters. Thus the labor rate in California for stair specialists is about $30 while carpenters make about $21 per hour. Since more than one man is usually involved in such installations, the extra cost to the builder can be quite sizeable.

It is an object therefore of this invention to provide a new low cost newel for both gallery and rake locations, that can be easily installed.

It is another object to provide a premanufactured balustrade that includes special newels as well as preferably premade rail systems.

It is a third object to provide a balustrade that can be priced to compete with wrought iron while providing the safety and good looks of a high end wood system.

It is a fourth object to provide a balustrade that can be installed after a bit of training by carpenters instead of requiring the use of specialists.

It is a fifth object to provide a premanufactured newel for installation at the gallery level, which is at the top of a flight of stairs and a rake newel which is mounted on the rake of the stair run, that is at an intermediate location.

It is a sixth object to provide a process for the installation of the pre-manufactured balustrade system.

Other objects of the invention will in part be obvious and will in part appear hereinafter.

The invention accordingly comprises the product possessing the features properties and the relation of its components as well as the series of steps recited that form the process disclosed herein, all of which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

This invention relates to a pre-manufactured balustrade and, in particular, to a premade newel and the process for installing a balustrade using the newel of this invention. The newel is a tubular member, optionally including a hex bolt disposed within an insert at the lower end thereof, which hex bolt has intermediate machine screw threads and distally located lag bolt threads, said lag bolt threads to be disposed in a support for the newel.

The process of installing the balustrade comprises mounting one newel at a gallery level, such as at the top of the flight of stairs, mounting the front newel, mounting any intermediate rake newels, and attaching the rail section there between, and finishing off the newels by attaching the newel cap to each newel. The newel mounting varies slightly depending upon at which of the three locations for newels that the mounting is to take place.

DESCRIPTION OF THE PREFERRED EMBODIMENT

Prior to discussing the invention of this application, it is deemed beneficial to the reader to provide a short lexicon of the various terms that will be utilized herein. Thus, a step consists of a tread, which is the part your foot steps on, and the riser, which is the elevated or vertical section. The depth of the tread is called the run.

A stairway consists of a series of flights of stairs connected by landings. A landing may be at a second floor, or at some intermediate point, where the stairs change direction. By having the stairs change direction, less floor space for an opening for the stairs is needed. Directional change stairways are often employed in homes with high ceilings. The vertical space occupied by a set of stairs or stairway is called the stair well.

The balustrade constitutes a total railing system to prevent a person or thing from falling laterally off the edge of any one tread. The post at the bottom of the stairway is called the starting newel. Whereas the post at any landing, that is flat area, where the stairs may or may not change direction (gallery) or at the top of the steps, is called a gallery newel. While a newel at an intermediate point in the flight, shall in this application be referred to as a rake newel(s). Newels often have a cap thereon for decorative purposes, which may be integrated therein as a unitary structure or added on. The rail section, that is disposed between any pair of newels includes a banister or handrail often designated the top rail, the bottom shoe and the balusters which are spaced horizontally apart in a generally vertically orientation, disposed between the banister a.k.a. top rail, and the bottom shoe.

Figure 1:
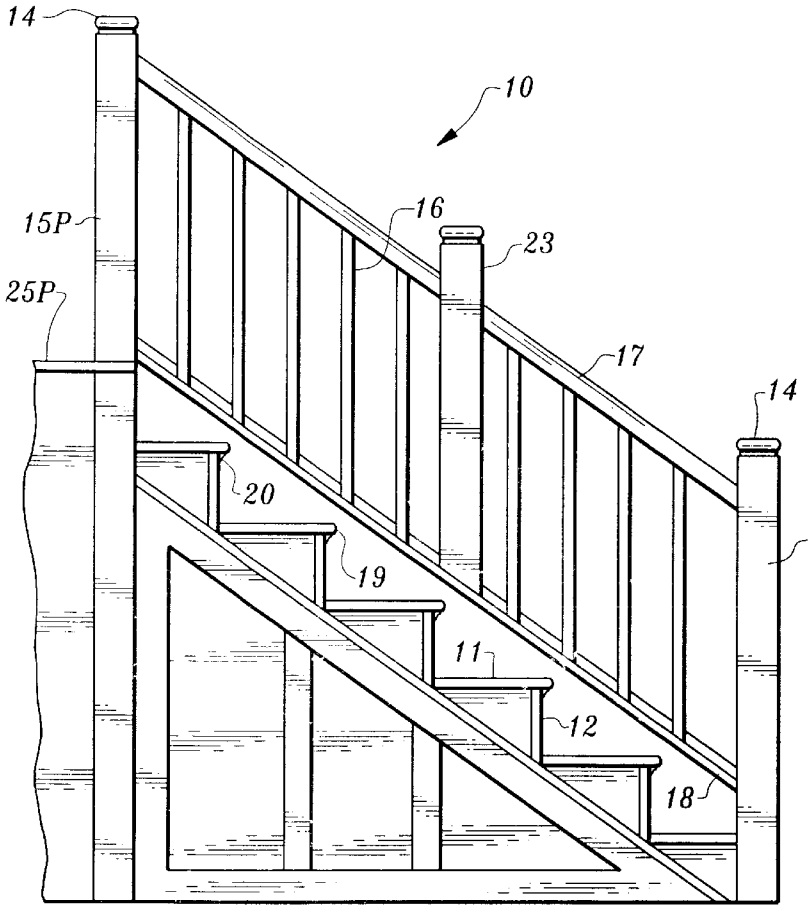
Fig. 1 (PRIOR ART)
FIG. 1 is a diagrammatic view of a typical prior art stairway.

The part of the tread of a step which overhangs the riser, is called a nosing. Sometimes the overhang may have a piece of decorative quarter-round molding strictly for cosmetic enhancement purposes as is shown in FIG. 1, the prior art depiction of the components of a stairway. For the ease of the reader, the part names have been recited in this figure. Since some of these parts of the stairway are also elements to be discussed in connection with this invention, these parts have been numbered for reference within the text of this application. Some or all of these will be referenced again infra.

Thus with reference to the prior art it is seen that the convention 13P is used for the prior art starting newel and 15P for the prior art gallery newel. The intermediate newel of this figure is designated 23P. The "P" designation is dropped, however, when reference is made to the newels made according to this invention when referenced as part of a balustrade.

Figure 2:
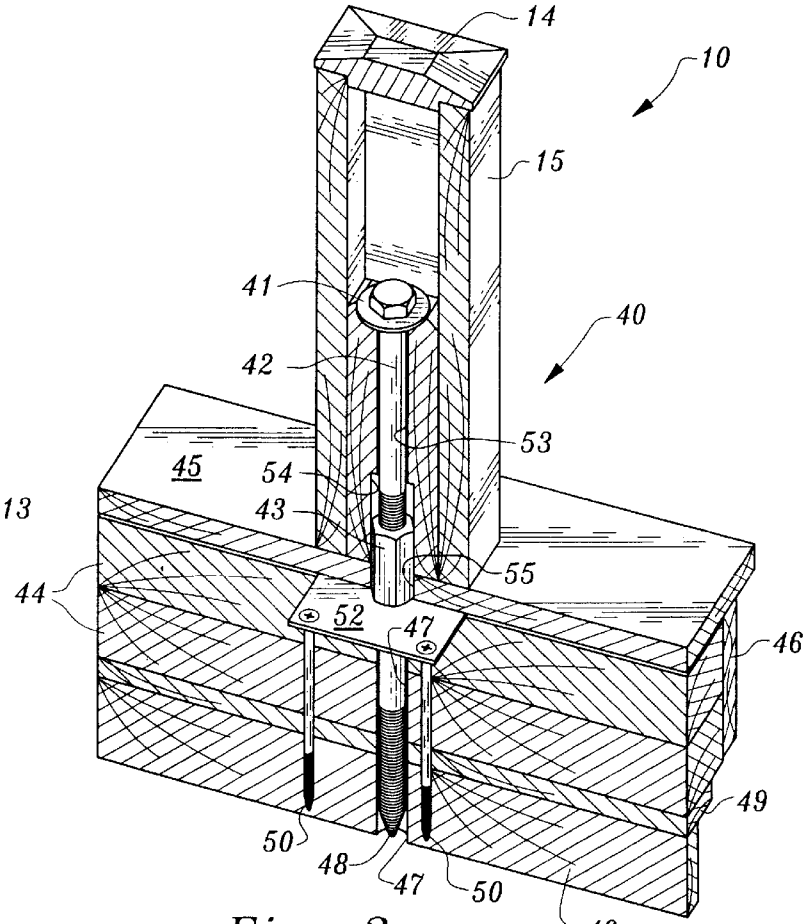
FIG. 2 is a sectional view of the gallery newel of this invention installed.
Figure 3:
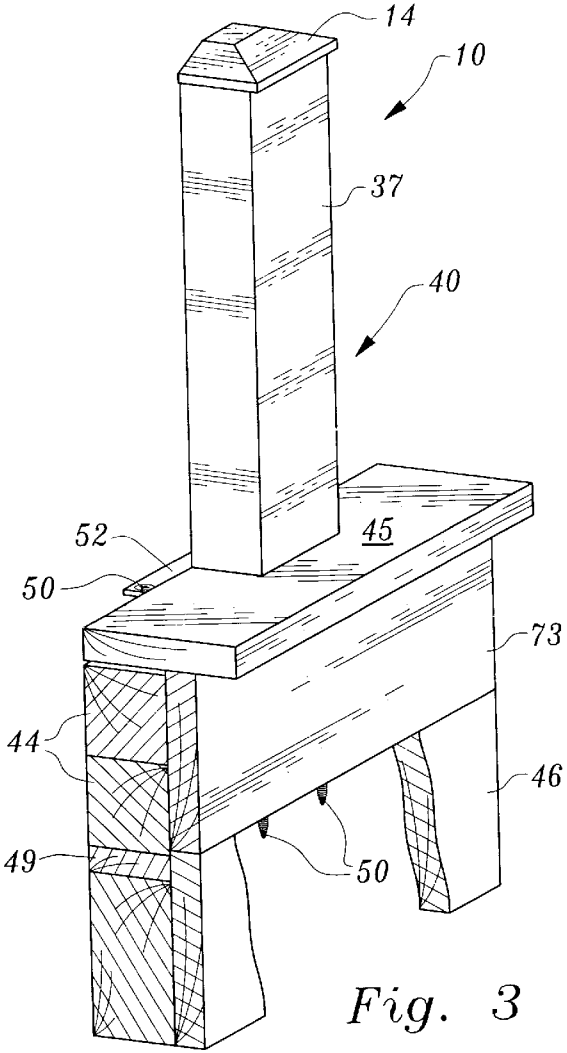
FIG. 3 is a perspective view, partially in cutaway showing the newel of FIG. 2 installed.

In FIG. 2, the most common landing or gallery installation is depicted for the newel of this invention. The opposite perspective from FIG. 2 is seen in FIG. 3. Here a fascia 73, not visible from the other perspective is sen. This is usually sheet rock. The joist referred to also as structural backing 46, often a 2×10 or 2×12 is shown cutaway to permit viewing of the screws 50. Such an installation is shown in the close-up diagrammatical view, FIG. 4. Please note that since FIG. 1 depicts prior art components, including the newels, the novel newel when considered alone is designated 40. It should be understood that the newel of this invention can be used both as a gallery newel, its main purpose, and as a rake newel as well, by merely angling the base.

Figure 4:
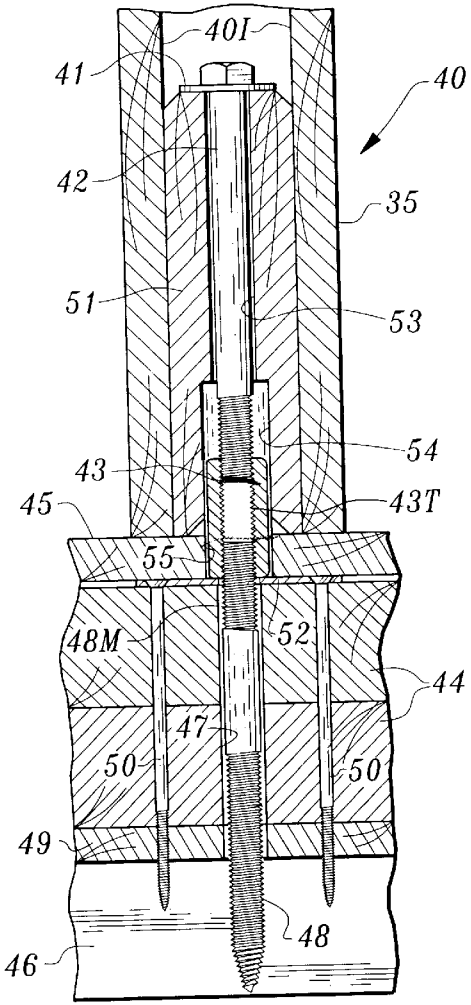
FIG. 4 is a diagrammatic closeup view showing the mode of installation of the newel as in FIG. 2.

In FIG. 4 we see newel 40 in vertical section i.e., the front member 36 is lacking. The newel is a four-sided, in this instance, hollow member formed of wood or other suitable materials such as medium density fiberboard (MDF) having sidewalls 34, 35 and front and rear walls 36, 37. In FIGS. 2, 4, 5, 6, 7 and 8 the front wall has been removed to permit the viewer to see the contents of the tubular member and to better understand the modes of attachment employed.

Note that the perspective for this nomenclature is based on a viewing of the balustrade such that the gallery is at the left and the starting newel at the viewer's right as per FIG. 1. But when a person would climb a flight of stairs, the right wall 35 of the starting newel is seen as one approaches the steps. See FIG. 14 for clarification.

The configuration of the newel can range from a cross section of circular to octagonal, to square or rectangular, as well as square or rectangular with chamfered corners as may be desired. The only requirement is that the center of the newel be open such that, in essence, a tubular member is presented. Newel 40 is seen to have an interior wood block insert 51 which may be of any wood such as oak or poplar. The insert may be chamfered along its top edges, or have hard 90 degree corner at its top edge as shown in FIG. 4. This insert 51 is glued or otherwise attached to the interior 40I of the newel, at the lower end thereof and extends upwardly about 6 to 8 inches. A pair of aligned bores, 53 and 54 are found in the insert vertically directed. Bore 53, the upper and of the lesser diameter commences at the top of the insert and extends approximately ⅔ the length of the insert. Bore #2, the lower and of a greater diameter, designated 54, extends through to the bottom of the insert. It may have a tapered opening as shown, or be strictly a vertical bore. Bore 54 extends from the point of termination of bore 53 to the lower end of newel 40. Thus the two bores communicate with each other. As is seen in both FIGS. 2 and 4, the newel is disposed upon a stair cap, which may also be made of MDF or solid wood as may be desired. Bore #3, 55 is centrally disposed within the stair cap 45 and is aligned with and of the same diameter as bore 2, 54. Bore 55 extends the full depth of the stair cap 45.

As is seen, the stair cap is slightly spaced away from the first of the two 2×4 plates 44 which are nailed or otherwise attached one above the other by the interposition of a preferably metal plate.

Interposed between the two 2×4 boards 44, called plates, which have been previously joined, and the stair cap 45 is a thin preferably metal plate 52 which may be sized from approximately 2.5 to about 4 inches square and is about ⅛th inch thick. This plate may be made of steel or aluminum alloy, or high impact plastic as may be desired. The preferably metal plate is to pull down the two 2×4s to the subfloor and serves as the basis for total alignment of the newel vertically. The plate is a rigid member not intended to be flexed and must be capable of supporting the load of the stair cap and the newel thereupon. The metal plate is rigidly held in place by four corner positioned Phillips screws 50, two of which are shown here. Such screws extend through the two plates 44 all the way down to the plywood subfloor 49. These Phillips screws may extend all the way through the subfloor to the space beneath the landing or gallery where this newel is disposed. To ensure easy installation of these 4 long Phillips screws, the drilling of pilot holes, not specifically numbered, is recommended. By so doing the two 2 2×4s will be drawn tightly together. One should ensure that the preferably metal plate 52 is absolutely level, as the desired true vertical disposition of the newel will be dependent upon the horizontal and level disposition of this plate 52. Thus sometimes the use of a shim, not shown may be necessary, but the use of such to achieve level accuracy is classically known among carpenters.

A lag bolt 48 having a headless configuration, but having machine screw threads 48M at its upper end and wood screw threads at its bottom end is disposed through the center bore 3 of the stair cap 45, through the preferably steel plate 52 and through suitable openings in the two pieces of plywood 47 into the subfloor 48 and perhaps therethrough.

The series of four wood screws, extend also through the curb, and subfloor, 49, but their heads are disposed along the top surface of the metal plate 52 and impact on the underside of the stair cap 45. A collar or coupling 43, having internal threads is threaded onto the lag bolt 48 machine screw threads 48M to fix the coupler, 43, which is usually six sided into a fixed position resting upon the metal plate 52. A hex bolt, 42 is inserted through a suitable ½-inch washer 41 for disposition through bore 1, designator 53, for connection to coupler 43 as per FIG. 4. The washer rests upon the upper surface of the insert 51 such that when the hex bolt 42 is tightened the bolt engages the interior threads of the coupler 43 to thereby retain the newel to the stair cap.

Since the metal plate 52 is fixedly secured to both the curb 44 and the subfloor 49, due to the presence of the lag bolt 48 in its respective opening 47, such that it can fully engage the subfloor 49;—the collar being attached to the bolt within the coupling is retained in a rigid fixed position, such that the coupling lag bolt and hex bolt form a unitary system to retain the newel vertically disposed relative to the stair cap such that the newel does not wobble.

Note the presence of the structural backing, i.e., joist 46 disposed beneath the subfloor which is intended to support the subfloor, 42 per FIG. 2.

It is noted that the bore or hole 47 within the curbs, in the 2×4's forming the curb 44 is necessary, to permit the unthreaded portion of the lag bolt as shown in FIG. 4 to pass therethrough, in order to be able to engage the subfloor with the threaded portion of said lag bolt. Again see FIG. 10.

Figure 5:
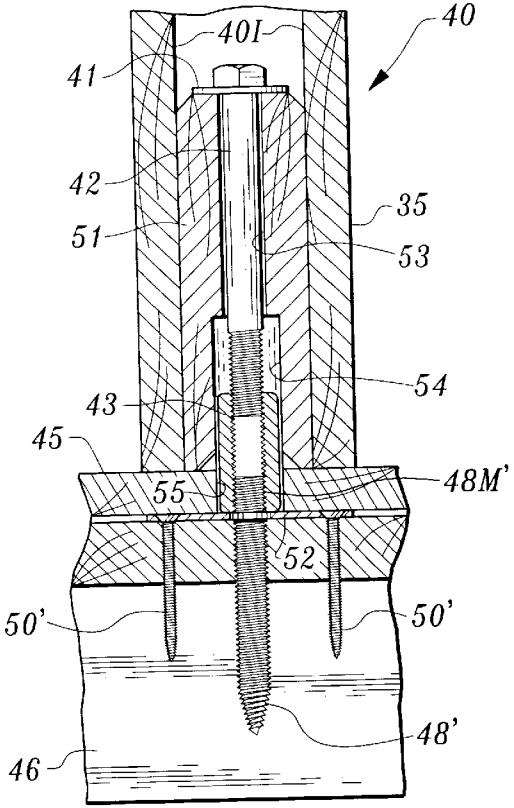
FIG. 5 is diagrammatic close-up view showing a second mode of installation of the newel of this invention.

In FIG. 5, a construction or mounting of the gallery newel to a subfloor without the intermediate curb is shown. However, since there is less support means for the connection of the metal plate 52, a shorter lag bolt such as 48', is utilized and a shorter set of wood screws 50 are utilized. Therefore in connection with the mounting shown in FIG. 5, the wood screws are designated 50', and would be of approximately four inch extension, whereas in the FIG. 4 version they would be approximately a five inch extension. In addition, the lag bolt in the FIG. 5 mounting through the rigid plate would be approximately 3½ inches long versus 6¼ inches long in the mounting of FIG. 4. Note, however, that in both instances, the head of the lag bolt is missing, and that the machine threads here 48M' at the upper end of the lag screw are shown threadedly engaged to the interior threads of the coupling 43, designated 43T. (Reference can be made to the discussion pertaining to FIG. 10 and that Figure for an understanding of how the headless lag bolt is positioned in place.) A careful viewing of FIGS. 4, 5 reveals that the elevation of the coupling 43 is less than the elevation of the bore 54 in the insert block 51.

Since the newel of the mounting shown in FIG. 5 is the same newel shown in FIG. 4, the designator 41 for the washer and 42 for the hex bolt remain the same, because they are the same as previously utilized. In order to give the newel a certain amount of stiffness, a wood block 51, or one of MDF, usually of about a 6⅜ths elevation rests, as is shown, disposed upon the cap 45. Such internal block need not be painted. However, the newel will have more lateral support disposed therethrough, than if it were standing solely directly upon the cap 45.

In the mode of attachment shown in FIG. 5 the structural framing such as floor joists 46 are also disposed in their normal location. As noted earlier, the structural framing serves to support the newels and is made for example of typical framing materials such as douglas fir or hemlock.

Figure 6:
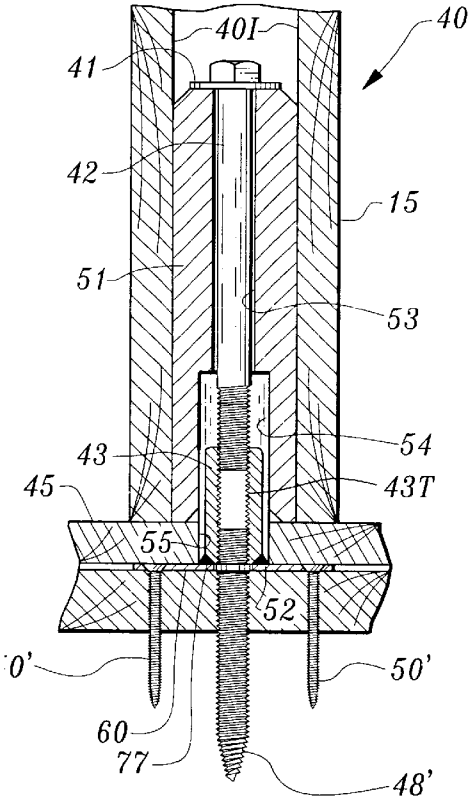
FIG. 6 is diagrammatic close-up view showing a third mode of installation of the newel of this invention.

Reference is now made to FIG. 6. Here, no backing 46, i.e., there is no floor joist present at the location of the newel. (Joists are spaced apart every 16 or 24" and in some instances such as shown in FIG. 6, no joist may be present beneath the proposed location for the newel.) The thin metal plate, 52, is attached in like manner directly to the subfloor as previously depicted and discussed relative to FIG. 5, but preferably a layer of glue, shown as the line 60, is first applied to lock the plate to the subfloor before it is screwed in. The cap with its central bore 55 rests directly on the plate and is spaced from the subfloor as previously discussed. Here, in order to secure additional support, the collar or coupling 43 is welded to the steel plate. The welds being denoted as 77. The connection of the machine screw threads of the lag bolt 48 to the internal threads of the coupler 43 is the same as previously disclosed. The same is true for the disposition of the hex bolt through washer 41 and bores one and two, 53 and 54 for threaded engagement to the threads 43T of the coupling. Note there again that a block 51 which may be made of wood or of MDF, is shown disposed upon the cap, 45. As is well recognized in the woodworking art block 51 should be pre-bored prior to insertion of the hex bolt 42.

While two reference numbers 42 and 48 have been used to identify the hex bolt and the lag bolt respectively, it is to be understood from the drawings that these are NOT one and the same fastener. Lag bolt 48 has terminal coarse threads and machine screw threads at its top and no head thereon. Again see FIG. 10. Attempts to utilize a one piece structure to combine elements 41 and 48 with the lag bolt, portion being at the lower tip and having coarse threads, with the machine screw threads of the middle of the bolt, and an elongated shank, with a head at the top. During the tightening of such a structure, the bolt fractured frequently and as such this approach was discarded in favor of the two bolt and coupling mode.

Figure 8:
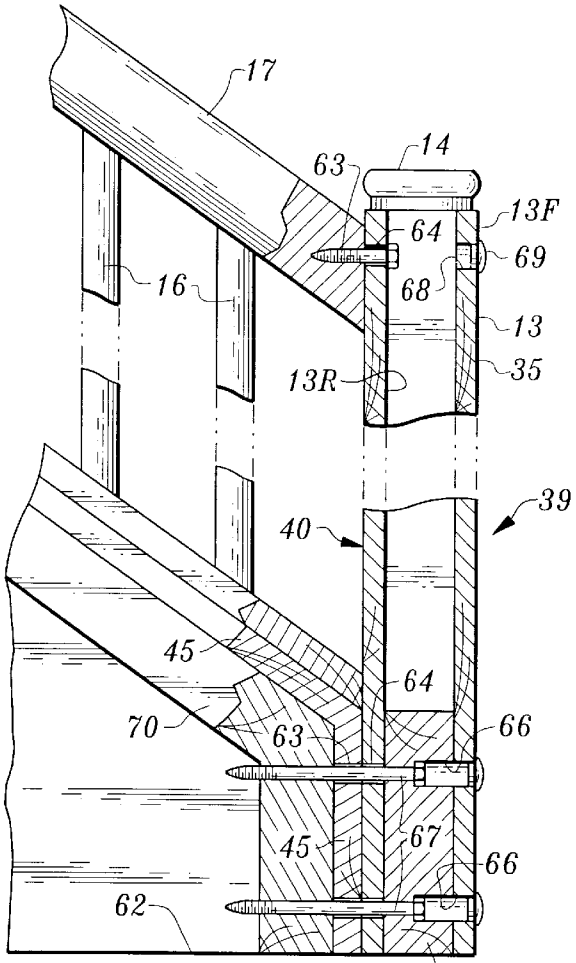
FIG. 8 is diagrammatic view which illustrated the installation of the front newel according to the process for installing balustrades according to this invention.

The discussion turns now to FIG. 8, for further discussion on the installation of the balustrade of this invention. Previously, we have discussed the mode of mounting the gallery newel or rear newel as the case may be. Such gallery newel may be an intermediate newel, or the last newel but can not be used as the first or front (starting) newel at the base of the stairway. Once the rail section, which includes rail 17 and the balusters 16 have been set in place, as will be more particularly described infra, the front newel is ready to be mounted to the rail section. Alternatively, the front newel can be partially mounted, and then the rail section interposed.

The front newel seen in FIG. 8 can be of the same internal construction as newel 40 previously discussed, that is the block 51 can be bored. It is preferred however, for both structural rigidity and cost of labor saving that a solid block insert designated 61 be employed instead. See infra.

First, one should confirm that the rail section has been plumbed such that when the front newel is attached, it will be totally vertical. The front newel 13 may be made of similar MDF material and is comprised of a tubular member of any cross sectional configuration. A relatively large opening 68 is made in the front face 13F of the newel, wall 35, such that access can be had to the interior surface of the rear face 13R. See FIG. 8. Such a hole 68 may be of about ½ to ¾ inch in diameter to give ready access to the rear face 13R. A bore 64 of a pilot hole nature, is made through the rear face 13R and into the rail 17. While it is preferred to create one continuous bore, these two pilot holes are being given separate designators 64 and 63, respectively. A ½-inch long lag bolt of approximately ¼ inch diameter, is disposed through the pilot hole 64 for threading into pilot hole 63 within the rail 17.

Reference to the figures shows that a solid block 61 is glued or otherwise attached in the hollow space of the newel at the lower end thereof and extends partially upwardly within the tubular member. This insert provides structural integrity to the lower end of the starting newel and lacks the two vertically communicating bores of the rake and gallery newels. A bore 68, is made in the front face of the newel, and continued into the insert where it is designated 66. Access hole 68, may extend approximately 1 inch into the interior of the block insert through the wall of the newel, 40. A bore 65 is directed through the center of the bore 68 through the newel into the stair cap 45, and may extend into any 2×4's or other materials disposed beneath the cap 45 and hidden from view by apron 70. Apron 70 is a decorative member that overlies a sheet of plywood such as is seen in the unfinished stairway of FIG. 13. Note, however, in FIG. 13 that no cosmetic apron is shown.

Lag screws 67 are inserted through the access holes 68, and are threadedly engaged through the cap 65 into any solid material lying beneath apron 70. As previously discussed, where two bores in different materials communicate with each other, though given separate names heretofore bore 66 and 67, they may be made as one continuous bore.

After the front newel, 13, is secured into place at its upper end into rail 17 and its lower end through the insert block, wooden plugs 69 of a decorative nature may be used to act as closures for the bores in the front face 13F of the newel. A newel cap 14 is then conventionally applied as by nailing or gluing and secured in place. See FIG. 18 and the discussion pertaining thereto.

Figure 7:
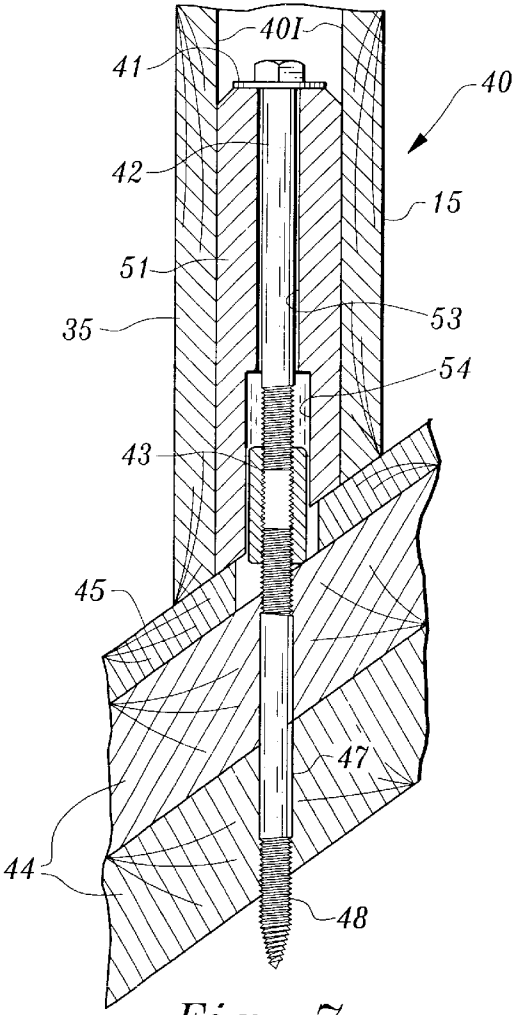
FIG. 7 is diagrammatic view from a reverse perspective of the installation on a rake newel.

If the run or extension, of the rail section is extremely long, it may be beneficial to install one or more additional gallery newels at intermediate location(s) along the run of the space between the gallery newel to be disposed on a landing and the front newel. This will provide additional stability to the rail section, 21, and permit shorter rail sections to be employed. Such a newel would be mounted on a rake or angle as shown in FIG. 7. It is seen that the two sidewalls 35, 34 are of differing elevations and that the front and rear walls have inclined bottom edges. The reader is also advised of the reverse perspective for FIG. 7, i.e., from on the steps, and as such the numbering for the sidewalls is reversed. Other aspects of the rake newel installation are similar to those for a gallery newel.

The mounting as per FIG. 7, is similar to that previously discussed with respect to FIG. 4, except that no subflooring is shown in this figure. Thus the bolt system goes through the insert 51, through cap 45 disposed at and angle and the curb formed of the two 2×4 plates 44.

Newel Installation Process

Previously we have discussed the structure of the newel of this invention and the components of its installation. As in any article or apparatus there is a mode or procedure for creating such apparatus. The discussion moves now to the process for installing a premanufactured rail section utilizing the premade newel of this invention as the gallery or rake newel to achieve a balustrade.

Figure 9:
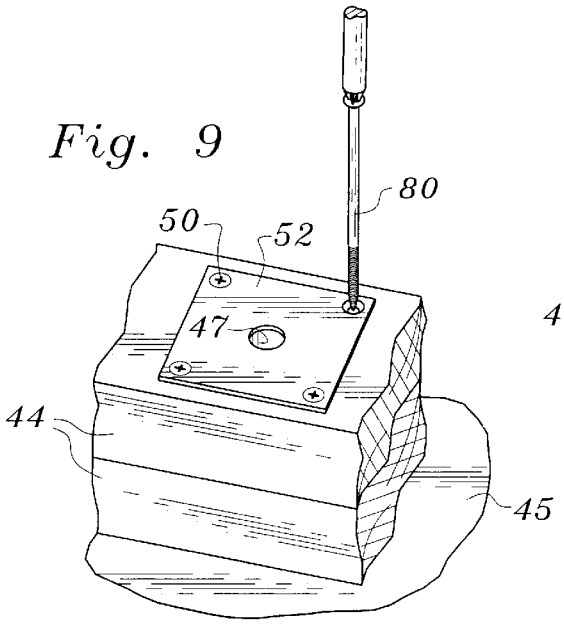
FIGS. 9 through 12 inclusive illustrate steps of the process of this invention, pertaining to newel mounting.

The discussion commences with FIG. 9 and pertains to the mode of installing a gallery or rake newel on a curb base positioned above the subfloor. The procedure commences with the mounting of the metal or plastic plate 52 to the curb 44 by the use of the screws 50, via a screw driver 80. It must be emphasized that a pilot hole, not numbered must be provided for each such screw in order to ensure that the two 2×4s are tight up against each other with no gap between them. Success of the installation depends upon the simple step of leveling the plate 52.

Figure 10:
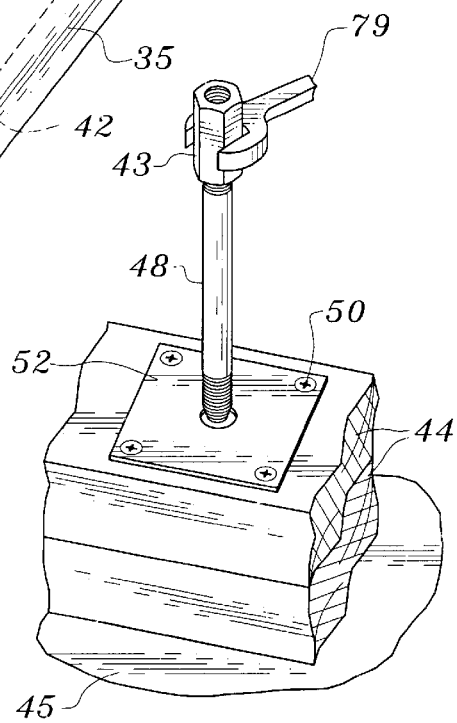

FIG. 10 illustrates the placement of the lag bolt 48 into a pre-made hole in the curb formed of the two 2×4 or 2×6 pieces of wood that have been presecured together. Typically a hand wrench 79, can be used as is shown in FIG. 10, for tightening the coupling 43—which has been manually threaded into position onto the machine screw threads 48M of the lag bolt 48; and by continuing the wrench use, for positioning the lag screw down into its desired position.

Figure 11:
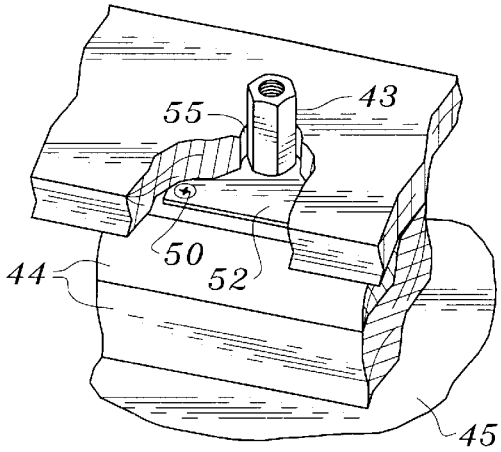

The next step, which is not illustrated, is the nailing or otherwise securing of the stair cap 45 to the curb 44, but such is readily understood by artisans. This is not done, however, until a bore 55 through the stair cap is made to align with the coupling such that the coupling will protrude therethrough. See FIG. 11. The cutaway shows the placement of the plate 52 with the coupling protruding through the opening 55 in the stair cap 45.

Figure 12:
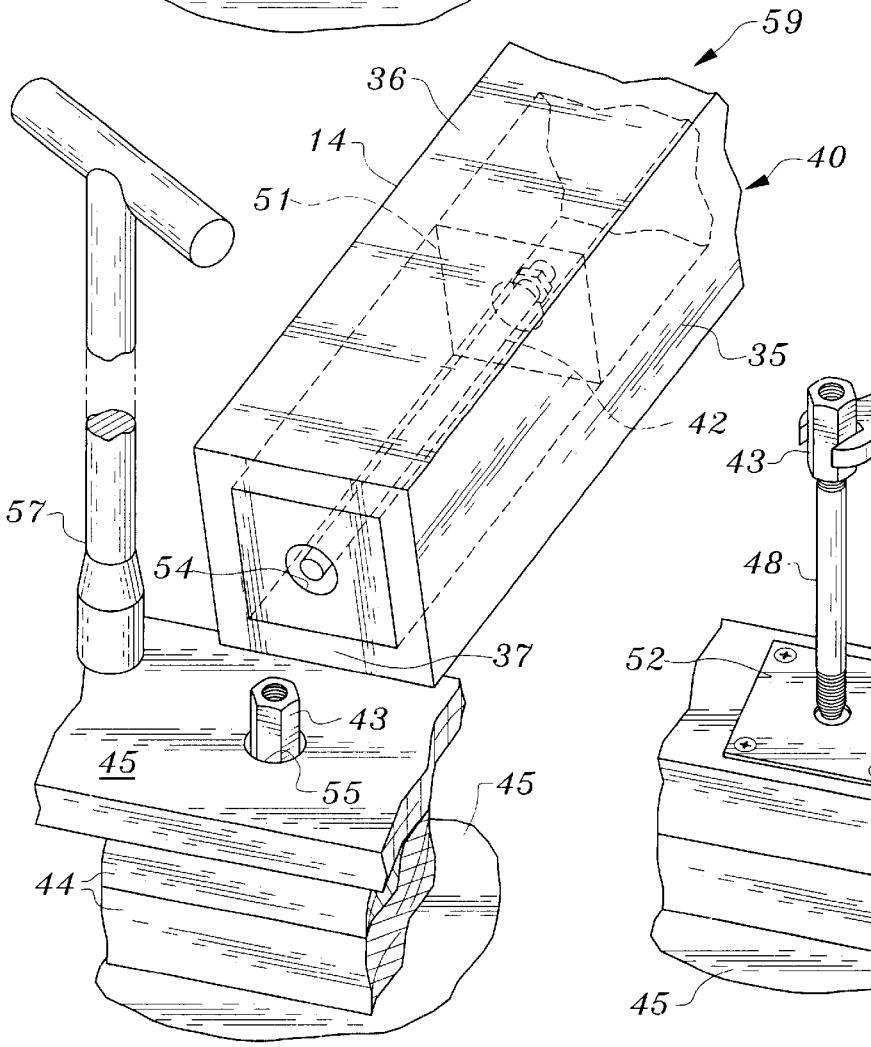
Figure 13:
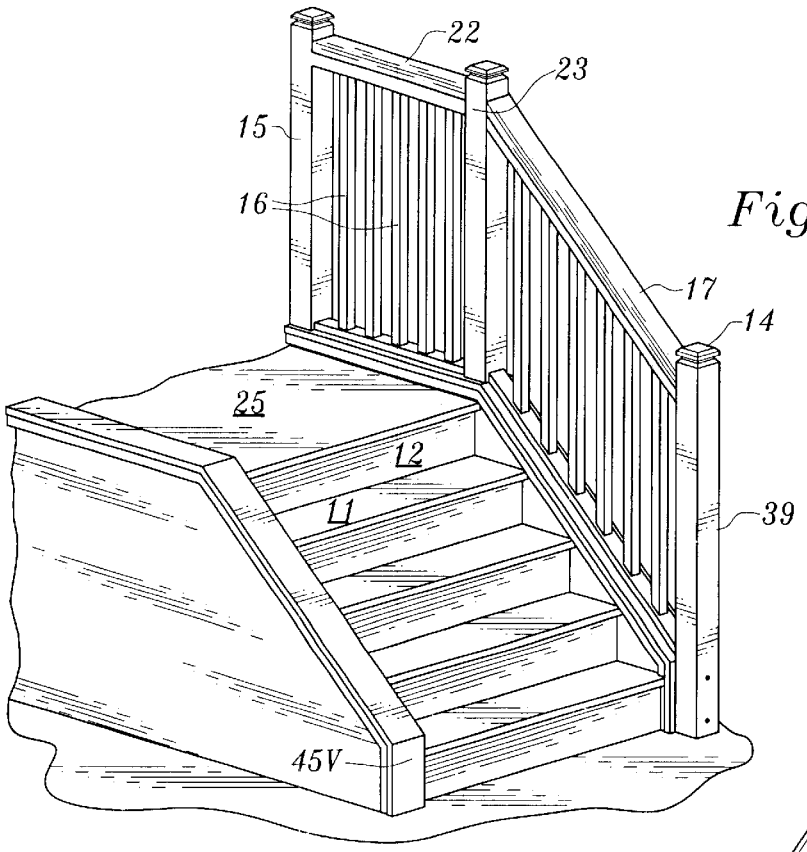
FIG. 13 shows a typical landing stairway with rear and intermediate newels according to this invention installed in position.

The discussion now turns to FIG. 12, where a gallery newel 40 is seen ready to be mounted at the top of the full stairway shown in FIG. 13. Note the presence of bolt 42 and washer 41 within the block 51. In order to indicate the fact that the newel 40, is of a hollow core, dashed lines have been presented. The wood block insert, 51, at the lower end of the hollow newel, is designated as being below the horizontal line between the two sets of spaced dashed lines.

As can be seen, the newel is about to be placed upon the coupling. The extension tool 57 also seen in this figure, is used to tighten the hex bolt 42 through the opening in the top of the gallery newel. See FIG. 18 which depicts this opening 58 at the top of the newel. Since the newel in FIG. 12 is truncated, arrow 59 is depicted to indicate that the tool goes down into the newel. The extension tool 57 has a head that tightens the hex bolt into the coupling as per FIG. 4 or 5 for example. The use of this tool is deemed well within the skill of the artisan. When the gallery newel(s) 40, are mounted in place, they are capable of standing upright. Again reference is made to FIG. 13.

Figure 14:
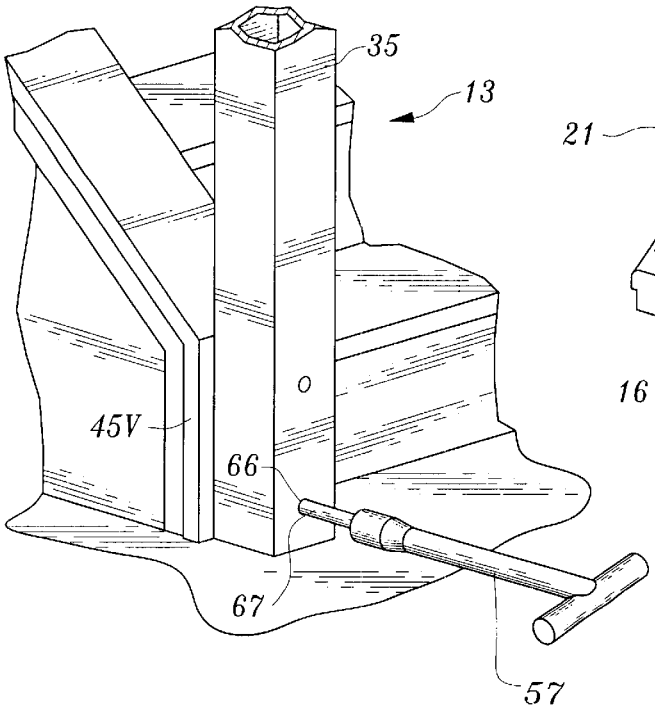
FIG. 14 illustrates a step in the mounting of the front newel according to the process of this invention.

The front newel, 39 which has been indicated as also being hollow and made either of MDF or wood or even plastic, is mounted to the vertical section 45V of the stair cap 45, which is seen in FIG. 13. The actual mounting is depicted in FIG. 14, where the same tool 57 is utilized. Reference is again made to FIG. 8 which shows the location for the use of the tool; namely, throughbore 66 to mount lag screw 67 into the vertical section of the stair cap 45V per FIGS. 7 and 13.

Figure 15:
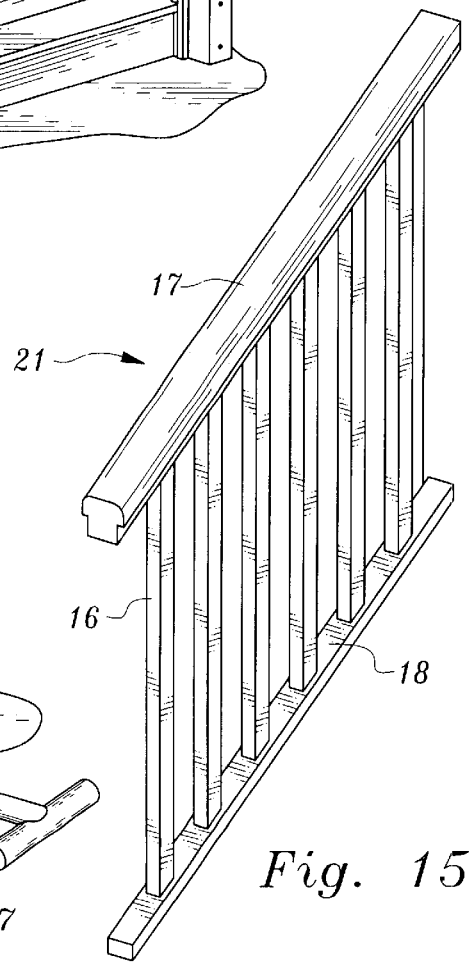
FIG. 15 is a perspective view of a rail section utilized in the process of this invention.

In FIG. 15, there is depicted a typical rake (angular disposition) rail section 21, which includes a top rail 17, a bottom shoe 18 and a plurality of spaced interposed balusters 16. The balusters are maintained in the generally vertical disposition and the spaced banister and bottom rail, called a shoe, are angularly disposed relative to the balusters but parallel to each other. The rail section is then placed between one of a gallery or a rake newel, such as the intermediate newel 23 of FIG. 13 and the front newel 13, for attachment of the front newel to the baluster using a similar technique as is carried out in FIG. 14 and the discussion related thereto. Attachment of the rail section 21 to the intermediate newel, 23 which in FIG. 13 is a gallery newel—as contrasted to FIG. 1 wherein the intermediate newel is a rake newel—is carried out in a conventional manner. Straight rail sections such as 22 that are attached between two gallery newels designated 15 and 23 is seen in FIG. 13. In such a rail section, the balusters are normally disposed (90°) to the banister and shoe. Attachment of rail sections 23 is carried out in conventional fashion.

Figure 16:
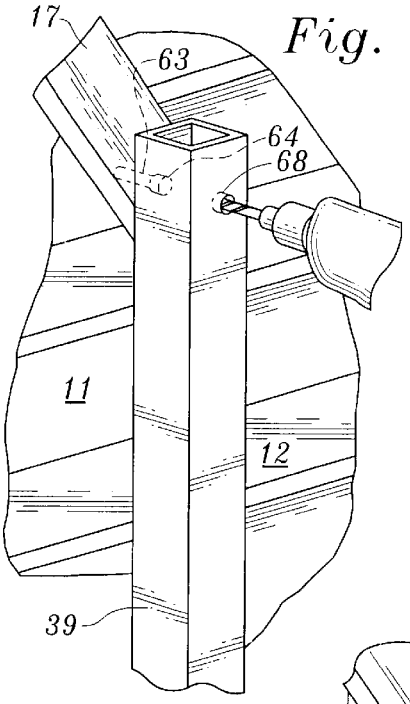
FIGS. 16 and 17 are perspective views illustrating the attachment of the rail section to the front newel according to this invention.

FIG. 16 illustrates the preparation of the upper section of the front newel 39, by drilling the bores 64, 63 into the rail 17 for insertion of a shortened lag bolt, 71 per FIG. 6. A shortened lag bolt is utilized, as the distance of travel is significantly less in the top rail 17 than through the cap and the curb, and any wood which may be behind these elements such as a subfloor.

Figure 17:
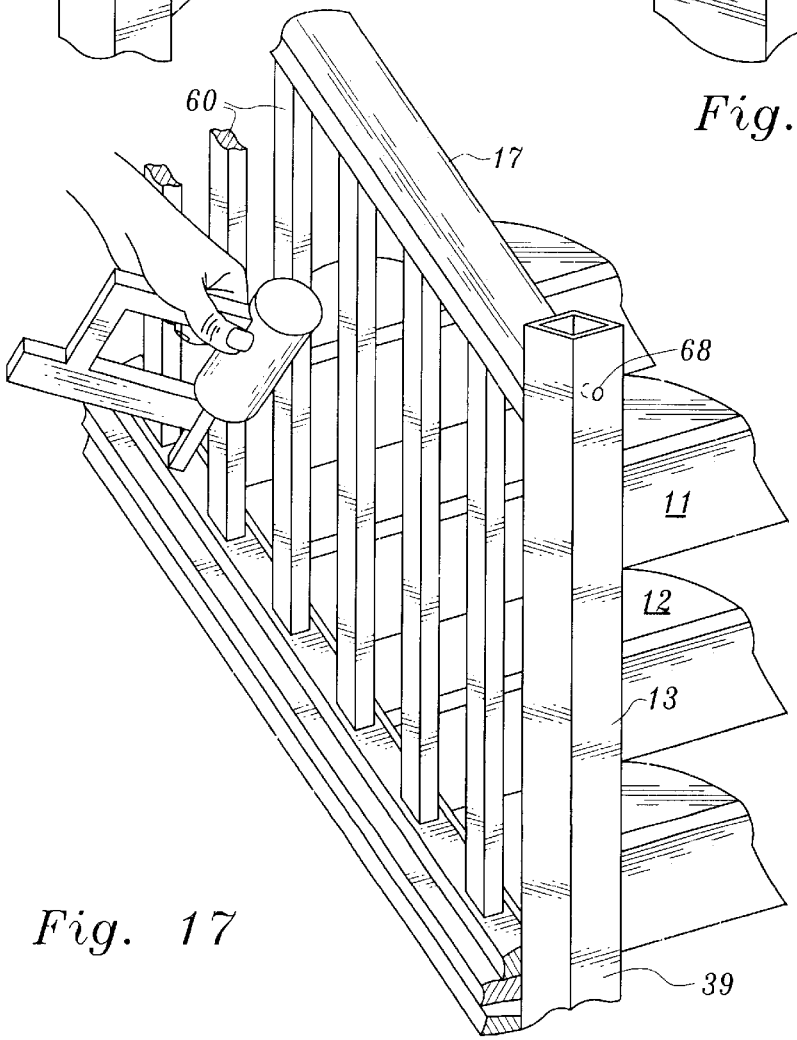

FIG. 17, shows the bottom rail being nailed into position using a typical electric nailer, unnumbered. Such attachment is also deemed conventional.

Figure 18:
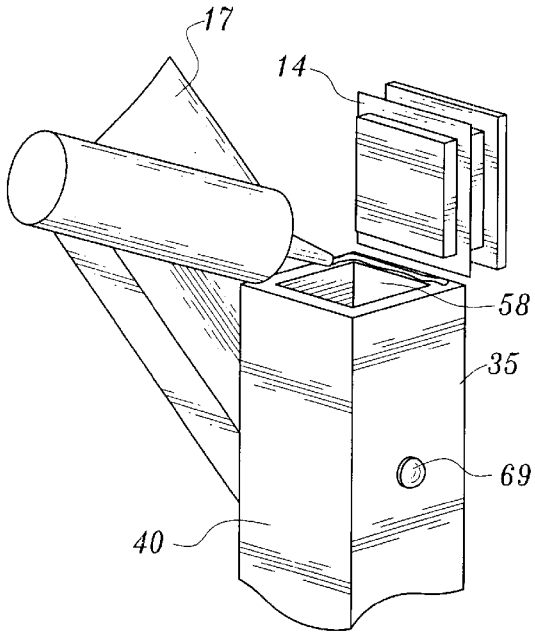
FIG. 18 is a perspective view illustrating the attachment of a newel cap according to the process of this invention.

The next step is shown in FIG. 18 wherein glue is applied to the top openings of all newels, here 40-O (39-O if a front newel) for the placement of the newel cap such as 14 also seen in FIG. 1 and FIG. 8 to create the illusion of a solid wood member.

Thus the same mode of construction for both a gallery newel and a rake newel can be used, the only difference being the angle of the cut at the bottom thereof; and, the same mode of installation can be employed for both. As to the use of this newel as a starting newel at the bottom of the flight of stairs, such can easily transpire, though the hex bolt is omitted as has been discussed supra, and the mode of installation differs also as has been discussed supra.

The balustrade can utilize the newel of this invention at one or both of the gallery and starting newel locations, and at an intermediate rake location if employed. disclosed an improved manner of installing a stairway utilizing one or more premade newels, with either premade or made on site rail sections. Premade straight rail sections are available in the marketplace.

The stairway balustrade disclosed herein can be installed in approximately ⅓ less time than typical traditionally installed stair balustrade systems, by someone with minimal training, but the result will be one of a high-craftsmanship level at a significantly lower price.

The balustrade can utilize the newel of this invention at one or both of the gallery and starting newel locations, and at an intermediate rake location if employed as may be desired. It is also seen that more than one gallery newel may be required and/or more than one intermediate newel may be required for the stairs where the balustrade is to be installed.

Since certain changes may be made in the above described product without departing from the scope of the invention herein involved, and certain changes can also be made in the procedural steps of the process disclosed herein, without departing from the scope of the invention, it is intended that all matter contained in the above description and shown in the accompanying drawings shall be interpreted as illustrative and not in a limiting sense.

I claim:

1. The process of installing a balustrade which comprises the steps of mounting at least one gallery newel, and mounting a starting newel spaced from said gallery newel, each of said newels being a tubular member having an insert attached to the interior of the newel, at the lower end thereof and extending partially upwardly therein, the gallery newel's insert having a vertically disposed pair of communicating bores of different diameters therethrough, and the starting newel's insert being a solid block, the mounting of both of said newels including the step of lag screwing the insert of each said newel to a support, the gallery newel being vertically attached and the starting newel being horizontally attached, attaching the rail section between the two newels, and finishing off the upper portion of newels by attaching newel caps to the open ends of said newels.

2. The process of mounting a gallery newel of a balustrade to a building's subfloor which process comprises;

a. attaching a thin apertured plate to the subfloor at the desired installation location;

b. placing the newel which comprises:

an open top and bottom tubular member having spaced front and rear walls and spaced sidewalls connected to the front and rear walls, all of which have an upper edge and a lower edge which member has an internally disposed block disposed a finite distance less than the total elevation of said tubular member, upwardly from the lower edge of the front, rear and sidewalls, said block having a first bore extending downwardly from the top surface thereof, to a point of communication with a second bore of a diameter greater than that of said first bore, and which second bore, extends upwardly from the bottom surface of said block, wherein a hex bolt having intermediate positioned machine screw threads and distally located lag bolt threads is disposed through and extends from the block disposed in said tubular member, and an internally threaded coupler is threadedly engaged to the machine screw threads of said hex bolt, said coupler being disposed in said second bore, at the desired location in alignment with the aperture of said thin plate;

c. tightening the bolt through said thin plate into the subfloor.

3. The process of claim 2 further including the step of closing off said tubular member with a newel cap.

4. The process of installing a rake newel of a balustrade which process comprises;

a. marking the spot for the location of the rake newel, b. pre-cutting the sidewalls and one of said front and rear walls to achieve the proper inclination of said newel's sidewalls whereby the newel will be substantially vertically disposed, c. placing a newel which comprises;

an open top and bottom tubular member having spaced front and rear walls and spaced sidewalls connected to the front and rear walls, all of which have an upper edge and a lower edge which member has an internally disposed block disposed a finite distance less than the total elevation of said tubular member, upwardly from the lower edge of the front, rear and sidewalls, said block having a first bore extending downwardly from the top surface thereof, to a point of communication with a second bore of a diameter greater than that of said first bore, and which second bore, extends upwardly from the bottom surface of said block, wherein a hex bolt having intermediate positioned machine screw threads and distally located lag bolt threads is disposed through and extends from the block disposed in said tubular member, and an internally threaded coupler is threadedly engaged to the machine screw threads of said hex bolt, said coupler being disposed in said second bore, at the desired location c. tightening the bolt into the marked spot to achieve a vertically disposed rake newel.

5. The process of claim 4 further including the step of closing off said tubular member with a newel cap.

6. The process of installing a starting newel for a balustrade which comprises:

a. selecting a newel of the proper elevation, which newel comprises:

an open top and bottom tubular member having spaced front and rear walls and spaced right and left sidewalls connected to the front and rear walls, all of which have an upper edge and a lower edge which member has an internally disposed block disposed a finite distance less than the total elevation of said tubular member, upwardly from the lower edge of the front, rear and sidewalls, said block having a first bore extending downwardly from the top surface thereof, to a point of communication with a second bore of a diameter greater than that of said first bore, and which second bore, extends upwardly from the bottom surface of said block, b. drilling at least one hole through the right sidewall of said tubular member, into but not through said block, c. drilling at least one pilot hole at the termini of said first drilled holes through said block and said left sidewall of said tubular member, d. adhesively secure the block within said tubular member to the predetermined location, e. lag screwing said newel through said at least one pilot hole to attach it to a substrate.

7. The process of claim 6 including the step of closing off said tubular member with a newel cap.

* * * * *